United States Patent [19]

Cruz-Uribe et al.

[11] 4,413,264

[45] Nov. 1, 1983

[54] PRINT MATERIAL SUPPLY CONTROL APPARATUS AND METHOD

[75] Inventors: Antonio S. Cruz-Uribe, Cobalt; Peter C. Di Giulio, Fairfield, both of Conn.

[73] Assignee: Pitney Bowes Inc., Stamford, Conn.

[21] Appl. No.: 338,691

[22] Filed: Jan. 11, 1982

[51] Int. Cl.[3] ..... G03G 15/00

[52] U.S. Cl. ..... 346/1.1; 355/14 D; 346/75

[58] Field of Search ..... 346/75, 140 R, 1.1; 355/3 R, 14 C, 14 D, 3 DD; 364/518

[56] References Cited

U.S. PATENT DOCUMENTS 2,956,487 10/1960 Giaimo ..... 355/14 D 3,529,546 9/1967 Kollar ..... 355/14 D

*Primary Examiner*—Elliot A. Goldberg

*Assistant Examiner*—Todd E. DeBoer

*Attorney, Agent, or Firm*—Peter Vrahotes; William D. Soltow, Jr.; Albert W. Scribner

[57] ABSTRACT

This invention relates to a system for controlling the amount of print material supplied to an electronic printer and, more specifically, for controlling the amount of ink or toner supplied to the sump of an ink jet printer or a photoelectrostatic copier that is used as a printer, respectively. The supply of print material is controlled by a determination of the amount of material that would be required to print a given text. This determination is based upon a knowledge of how much print material is required for various characters and the make-up of characters in the text.

1 Claim, 1 Drawing Figure

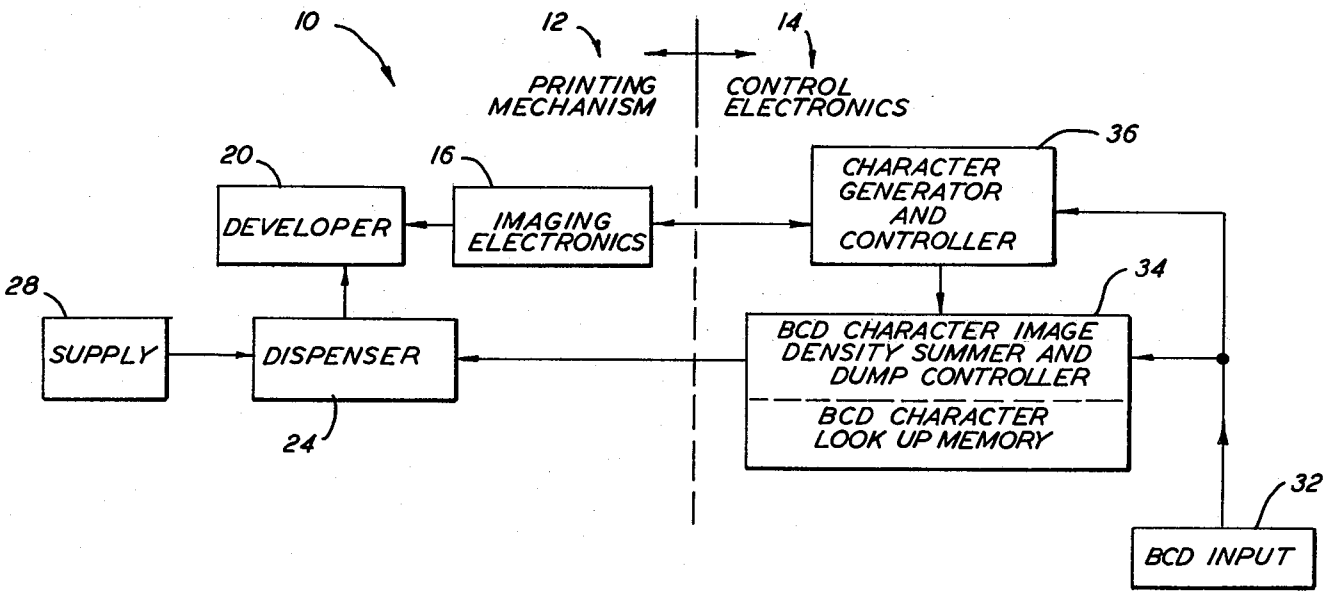
10
12
PRINTING MECHANISM
14
CONTROL ELECTRONICS
16
IMAGING ELECTRONICS
20
DEVELOPER
28
SUPPLY
24
DISPENSER
36
CHARACTER GENERATOR AND CONTROLLER
34
BCD CHARACTER IMAGE DENSITY SUMMER AND DUMP CONTROLLER
BCD CHARACTER LOOK UP MEMORY
32
BCD INPUT

PRINT MATERIAL SUPPLY CONTROL APPARATUS AND METHOD

BACKGROUND OF THE INVENTION

This invention is concerned with electronic printers of the non-impact type. As used throughout this specification, including the claims, the term electronic printer encompasses those printers in which information concerning the text to be printed is supplied electronically. Examples of systems that would have use of electronic printers are facsimile machines, word processors and computers.

In electronic printers of the non-impact type that contain a sump for holding print material, means is usually provided for automatically replenishing print material, such as ink or toner, as the print material is consumed. As an example, in an ink jet printer a sump is provided for holding liquid ink that is used during the printing operation. There is usually some type of measuring device to determine how much ink remains in the sump and filling means for providing additional print material to the sump as it is consumed. In a xerographic printer that uses dry, two component development powder, a sump also is provided which periodically must be supplied with replacement toner. The replacement of print material in such systems is either performed randomly or through a method of measuring the quantity of printing material remaining and replenishing it. With particular reference to a printer using the xerographic process and where a dry, two component toner is used in combination with a magnetic brush, random feeding is usually the case. More specifically, in an electronic printing operation wherein a xerographic printing process is utilized, an image is created on a photoconductive surface, as for example, through either exposure to light emitting diodes (LEDS) or through laser beam exposure. In either case, the image is created by the exposure to light in accordance with information stored in a memory and supplied therefrom to the imaging electronics. Typical of such a system, a hopper containing the toner is stationed over the sump of a magnetic brush unit and a rotary member containing pockets is located at the bottom of the hopper and rotates to supply material to the sump. The rotation of such rotary member is controlled by the operation of the printer and bears no relationship to the toner being consumed during the development of the image. As a consequence, since there is no relationship between the amount of print material being consumed and the amount of material that is supplied, variations in the density of the printed matter occur. Another means for replacing consumed toner is a toner density controller wherein the ratio of toner to carrier particles is measured. When the percentage of toner drops below a given level, the toner is replenished. As is known, such toner density controllers are expensive and generally lack accuracy. Obviously, it would be desirable to have a direct correlation between the amount of print material being consumed by an electronic printer and the amount supplied for the printing operation.

SUMMARY OF THE INVENTION

This invention is directed to printers wherein the text to be printed is supplied electronically and a memory is accessed for the purpose of determining the amount of print material that will be required. More specifically, this invention is concerned with printing operations wherein information relative to the text to be printed is supplied to a character generator and controller. This character generator and controller receives information concerning the text to be printed from a binary coded decimal (BCD) input signal and stores the information prior to printing. The BCD input also supplies the same information to a BCD character image density summer and dump controller (DSDC). This latter unit includes a memory that stores information relative to the amount of print material that will be required to print various characters. The memory is accessed and the quantity of print material required to print the text from the information supplied is determined by the DSDC. When such information is ascertained, control of a supply dump is enabled in accordance with the number of pages of text to be printed.

BRIEF DESCRIPTION OF THE DRAWING

The single drawing shows a block diagram of a system that controls the amount of print material supplied to the sump of a printer.

DETAILED DESCRIPTION OF THE PREFERRED EMBODIMENT

Referring now to the drawing, the block diagram represents units of a non-impact printer of the type to which the invention is directed. The printer is shown generally at 10 and comprises a printing mechanism shown generally at 12 and control electronics shown generally at 14. The invention will be described in conjunction with its use in a xerographic printer but it will be understood that the invention may be applied to other types of non-impact printers such as an ink jet printer. The printing mechanism 12 includes an imaging electronics unit 16 which may be either a photoconductive layer in combination with a light emitting diode array, or other similar device, and a developer 20 which is utilized to develop an image created by the imaging electronics. A toner dispenser 24 is in contact with the developer 20 and is capable of supplying print material thereto. A toner supply unit 28 is in engagement with the toner dispenser 24 to supply toner to the dispenser 24 as required. The toner supply unit 28 is a bulk supply device such as a hopper and the toner dispenser 24 may be a roller having pockets therein which is located at the bottom of the hopper and whose rotation is controlled by the control electronics 14.

Referring now to the control electronics 14, it is made up of a binary coded decimal input (BCD) 32 which supplies the signals for representation of the text to be produced. The input 32 is supplied to a BCD character image density summer and dump controller (DSDC) 34 that includes a character look-up memory and to a character generator and controller (CGC) 36. The CGC 36 is in electrical connection with the imaging electronics 16 so as to be able to convey signals representative of the characters to be generated. The imaging electronics 16, on the other hand, sends synchronization pulses to the CGC 36 so that there may be coordination between these two members. The CGC 36 also is in electrical connection with the (DSDC) 34 to indicate the number of characters or pages that have yet to be produced. The DSDC 34 in electrical connection with the toner dispenser 24 so as to control the amount of print material which is supplied to the developer.

The binary code decimal (BCD) input 32 is monitored by both the CGC 36 and the DSDC 34 which determine how many of each character are to be generated by the printing mechanism 12. The DSDC 34 contains knowledge with regard to the amount of toner required to print each character. This is used to calculate the overall toner that will be required. Since the toner requirement is determined before all the characters to be generated are printed, an incremental control for the toner dump is provided which is based on both past and future toner usage. The CGC 36 receives the text from the BCD input 32, including the number of pages and number of each page to be printed. This information may be received prior to printing or during. As the printing operation starts, the CGC 36 will transmit to the imaging electronics signals that will cause an image to be created on a charged photoconductor.

The method is extremely suitable for use with a CGC 36 that stores and backlogs the documents to be printed so as to electrically collate the pages of each document. A typical example for such a CGC 36 is a RAM or a disk storage system which can store a number of documents and the number of times each document is to be printed. Each document may consist of one or more pages of text material. The characters which comprise each page can be of any font and the DSDC 34 may include grey scale capability. As the CGC 36 receives and stores the text of the documents from the BCD input, the DSDC 34 determines how much toner will be required to print each document in one of two similar ways, as will be described hereinafter. As the documents are printed, the DSDC 34 controls the amount of toner furnished for printing these documents so as to assure both that the printer mechanism 12 does not run out of toner and that the developer 20 has not been given more toner than it can handle. The DSDC 34 receives from the CGC the number of documents left to be printed. This information is needed so that the DSDC 34 can pace itself with respect to the current toner needs of the printing mechanism 20. The DSDC 34 will signal the toner dispenser 24 to supply the required amount of print material to the developer 20 on an incremental basis.

As stated previously, the invention has been described as applied to xerographic printing. As applied to ink jet printing, the modules shown in the drawing would be the same with the developer 20 being an ink jet head, the toner dispenser 24 being an ink dispenser that would supply ink to the ink jet head and the toner supply 28 would be a supply of bulk ink that replenishes the ink dispenser.

There are two ways for determining the amount of print material required to print a particular document. One way is to keep a count of the number of times each character of a certain font or type, at a given grey level if required, is to be printed. This will yield a number of sums, each sum representing the number of times a different character is to be printed. These sums are then multiplied by the amount of print material which is required to print the respective character and the resulting products are added to yield the amount of print material required. This total amount of print material required for reproducing the document or documents should be developed as a running sum utilizing a look-up table for the required toner per character printed. This avoids having to store the number of each character printed and performing the calculation of the total document print material requirements after the documents are completely read.

The second way of determining the print material requirement involves having a look-up memory based only on font and, if required, grey level. The amount of print material required to print any character of a particular font or type would be a fixed value previously determined by a statistical study of the expected frequency of character usage in the printer 10. The print material amount for such a font would be the average of the amount of print material per character in that font weighted by the expected frequency of its use in the printed document. This method is approximate in nature since it assumes the frequency of character usage in documents printed. It should, however, provide a reasonably accurate measure of print material requirement.

What is claimed is:

1. A method for controlling the amount of print material supplied to an electronic printer, the steps comprising: supplying information relative to a text to be printed, storing the text information, operating a printer to reproduce the text in response to the stored text information, performing a statistical study of the expected character usage, determining the amount of print material required to print each type of character, determining the amount of print material required to print the text information stored based upon the number of characters to be printed and the weighted average of the amount of print material required per characters, and supplying print material to the printer in accordance with the amount determined.

* * * * *